United States Patent [19]

Takanashi

[11] Patent Number: 4,649,974

[45] Date of Patent: Mar. 17, 1987

[54] HANDBAG

[75] Inventor: Tadao Takanashi, Ibaragi, Japan

[73] Assignee: TR Co., Ltd., Ibaragi, Japan

[21] Appl. No.: 752,508

[22] Filed: Jul. 8, 1985

[30] Foreign Application Priority Data

Aug. 29, 1984 [JP] Japan ..... 59-129774[U]

[51] Int. Cl.[4] ..... A45C 1/02; A45C 3/08

[52] U.S. Cl. ..... 150/100; 150/103; 150/129; 150/130

[58] Field of Search ..... 150/103-105, 150/129, 100, 130

[56] References Cited

U.S. PATENT DOCUMENTS

| | | | |
|---|---|---|---|
| 1,828,342 | 10/1931 | Sachs | 150/129 X |
| 1,927,590 | 9/1933 | Isaacson | 150/105 |
| 2,006,463 | 7/1935 | Landis | 150/104 |
| 2,518,572 | 8/1950 | Sanders | 150/103 |
| 2,522,549 | 9/1950 | Waggoner | 150/104 |
| 2,606,588 | 8/1952 | Kaufman | 150/129 X |
| 2,656,870 | 10/1953 | Wishnia | 150/104 |
| 3,845,799 | 11/1974 | Mittell | 150/105 X |

FOREIGN PATENT DOCUMENTS

| | | | |
|---|---|---|---|
| 111393 | 7/1964 | Czechoslovakia | 150/103 |
| 1108023 | 8/1955 | France | 150/105 |
| 1386194 | 12/1964 | France | 150/103 |
| 648544 | 1/1951 | United Kingdom | 150/105 |
| 952542 | 3/1964 | United Kingdom | 150/105 |

*Primary Examiner*—William Price
*Assistant Examiner*—Sue A. Weaver
*Attorney, Agent, or Firm*—Murray and Whisenhunt

[57] ABSTRACT

A handbag having a replaceable decorative cover is provided. The decorative cover has a laminated structure. A face sheet, a central core sheet and a back sheet are bonded to one another with the central core sheet between the face sheet and the back sheet. The central core sheet is a size smaller than the face and back sheets. The lamination is done by bonding the peripheral margins of the face and back sheets while the central core sheet is applied with adhesives at appropriate portions to be bonded to the face and back sheets. In this way, the peripheral marginal area of the laminated decorative cover is thinner than the central area thereof with the result that the marginal area can be inserted under the frame attached to the cover or body of the handbag without causing the frame to bulge. In addition, the laminated structure provides a wide range of alternatives in material selection.

2 Claims, 5 Drawing Figures

HANDBAG

BACKGROUND OF THE INVENTION

This invention relates to a handbag of the type that fits the atmosphere of various occasions by replacing a decorative cover.

Handbags are frequently changed to match the clothing, etc. of the carrier or the atmosphere of the occasion. There are several factors in handbags that create aesthetic effects of their own. Among them, the material of the body and the cover portion, the design of their pattern, or the like are considered to be the leading factors which have a large influence on the appearance of the handbag. And, there has been such a demand that the decorative cover sheet should be replaceable in order to use the handbag in harmony with the atmosphere at the time when it is used. In response to such demand, there has conventionally proposed a handbag which has a replaceable decorative cover sheet with fasteners. However, a handbag of this type has such a disadvantage as that when the dimensions of the decorative cover sheet and the handbag body are not precise, it produces a poor appearance. On the other hand, it is not feasible to collect various types of replaceable decorative cover sheets which have dimensional accuracy. Besides, it was often uneconomical to purchase and keep assortments of such expensive decorative cover sheets.

Another prior art proposes that a picture-frame-like frame portion is provided in the periphery of the cover portion so that the marginal portion of the decorative cover sheet can be held between this frame portion and the handbag body. According to the method, even if the dimensions and shapes are not in agreement to some extent, much inconvenience is not caused as long as the sizes are not too large. However, it is necessary for the decorative cover sheet to have sufficient flexibility and at the same time sufficient hardness for maintaining its shape. This means that the materials which can be used for the decorative cover sheet are limited.

The present invention was accomplished in view of the above.

SUMMARY OF THE INVENTION

It is therefore an object of the present invention to provide a handbag which is capable of replacing a decorative cover in accordance with seasons, clothing of its carrier, atmosphere of the occasion, etc.

Another object of the invention is to provide a handbag which has a decorative cover of improved structure so that any flexible sheet material can be used regardless of its quality and physical property.

In order to achieve the above objects, there is essentially provided in one aspect a handbag composed of a body section having a front side and a back side, said front and back side defining an opening therebetween; a lid section integrally extending from said back side to cover said opening; a frame member attached to said lid section at an outside margin thereof; a laminated decorative cover inserted between said lid section and said frame member, said laminated decorative cover being composed of a face sheet, a central core sheet and a back sheet laminated with the central sheet between said face sheet and said back sheet, said central core sheet being smaller in area than said face and back sheets, said face and back sheets being bonded to each other at a peripheral margin thereof, said central core sheet being bonded to said face and back sheets at selected points.

There is further provided in another aspect a handbag which is composed of a body section having a front side and a back side; a frame member attached to said at least one of said front and back sides at outside margin thereof; a laminated decorative cover inserted between said at least one of the front and back sides at an outside margin thereof and said frame member, said laminated decorative cover being composed of a face sheet, a central core sheet and a back sheet with the central core sheet between said face sheet and said back sheet, said face and back sheets being bonded to each other at a peripheral margin thereof, said central core sheet being bonded to said face and back sheets at selected points.

DETAILED DESCRIPTION OF THE EMBODIMENT

A preferred embodiment of the present invention will be described hereunder with reference to the accompanying drawings.

Figure 1:
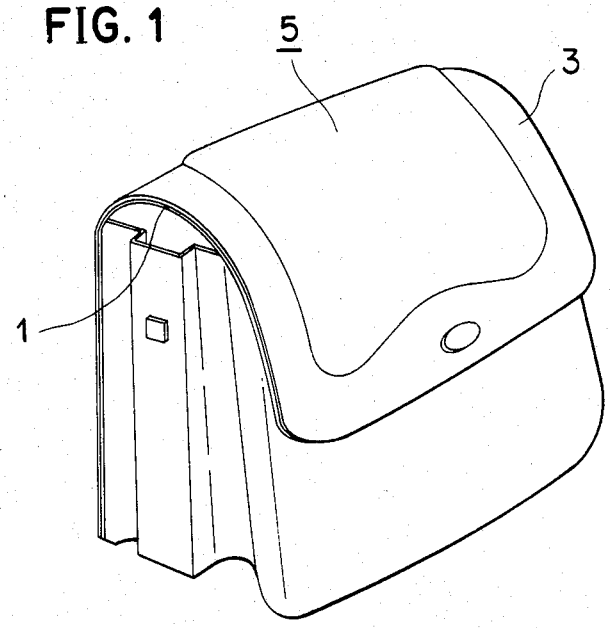
FIG. 1 is a perspective view showing the appearance of a handbag according to the present invention.
Figure 2:
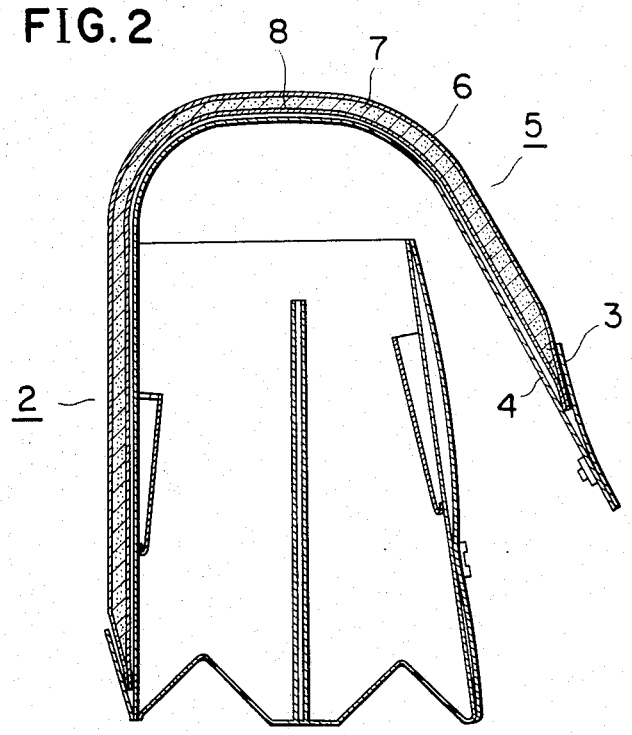
FIG. 2 is a vertical sectional view of the above.

FIG. 1 illustrates one example of the appearance of a handbag having a front side and back side, and FIG. 2 is its vertical sectional view. In the figures, a lid section 1 is provided at its peripheral portion with a picture-frame-like frame member 3. This frame member 3 is continuously extended from the back side 2 of the body to surround its entire peripheral portion of the lid section and the back side of the body section. The lid 1 comprises a back leather sheet 4, the frame member 3, and a laminated decorative cover 5 inserted at its marginal portion into between the back leather sheet 4 and the frame member 3. Said laminated decorative cover 5 comprises a face sheet 6, a central core sheet 7 and a back sheet 8 attached to one another by a double coated adhesive sheet 9.

Figure 3:
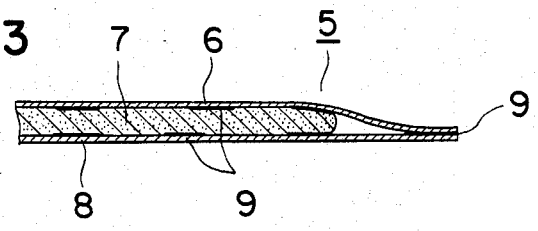
FIG. 3 is an enlarged sectional view showing its laminated decorative cover.

FIG. 3 illustrates an enlarged view of the laminated decorative cover 5. The central core sheet 7 is made a size smaller than the face sheet 6 and the back sheet 8. The face sheet 6 is directly attached to the back sheet 8 at the marginal portion thereof with said central core sheet therebetween to produce the laminated decorative cover 5. Consequently, the central portion becomes somewhat thicker than its marginal portion.

The back sheet 8 is required to be flexible and at the same time to have enough hardness to maintain its shape. For example, a thick synthetic leather sheet made of paper impregnated with a soft synthetic resin, rubber, etc., and a non-woven fabric is preferably used. Similarly, a synthetic resin foam, inter alia, urethane foam sheet is preferably used as the central core sheet 7 in order to make the cover soft to the touch.

Such materials as a woven fabric, non-woven fabric paper, synthetic resin sheet, etc. besides a natural leather, synthetic leather, artificial leather, etc. can be suitably selected for use as the face sheet 6. And, a double coated adhesive sheet or tape made of a non-woven fabric or paper, etc. impregnated with an adhesive agent are preferably used as a double coated adhesive agent 9 for bonding these sheets.

When these sheets are stacked up for bonding each other by the double coated adhesive agent 9, attention should be given to the following points. In case the face sheet 6 having hardness to some extent should be used, the adhesive material would not be applied to the entire surface of the sheets. Instead, it is enough to apply the adhesive material to suitable points of its central area and its marginal portion respectively. By this, the central core sheet 7 is prevented from being displaced and the face sheet 6 is prevented from being raised. On the contrary, in case the face sheet 6 having sufficient flexibility and elasticity as in the case with a woven fabric, knit cloth should be used, the central core sheet 7 should preferably be bonded to the entire surface of the face sheet 6.

It is preferable to employ suitable bonding methods in accordance with the physical property of the face sheet.

Figure 4:
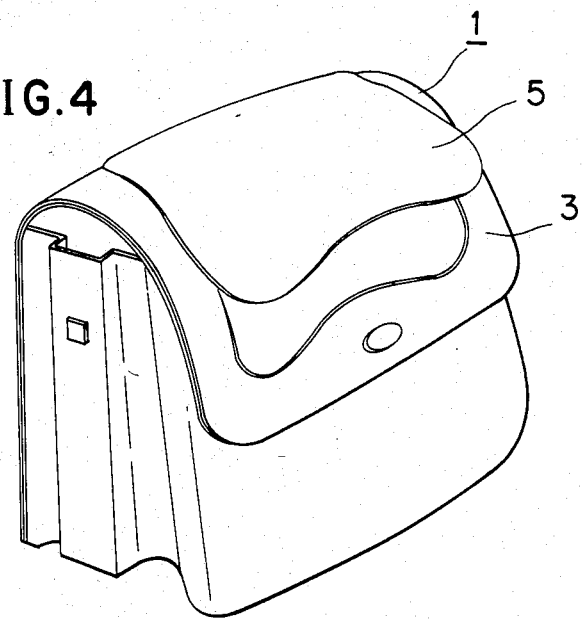
FIG. 4 is a perspective view showing part of the decorative cover being removed from the lid section of the handbag.

Referring to FIG. 4, the laminated decorative cover 5 which has been held between lid section 1 and the frame member 3 is being removed therefrom.

The laminated decorative cover 5 having the above mentioned multilayer structure is made in agreement, at least, in the external surface of the lid section 1. Alternatively, a large sized decorative cover 5 may be employed to cover as far as the back side 2 of the body. Likewise, if the body is provided at its front side with a separate frame portion for fitting therein a laminated decorative cover having the similar structure prepared separately, the design of the handbag becomes uniform as a whole and therefore more preferable.

Figure 5:
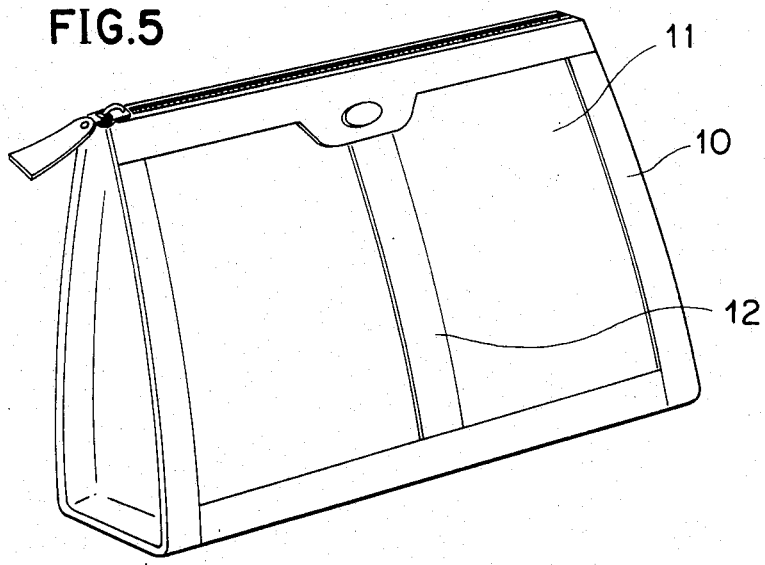
FIG. 5 is a perspective view of another embodiment of the invention.

Referring to FIG. 5, there is shown another type of handbag embodying the present invention which has its opening closed or opened by a zip-fastener. A frame member 10 is attached to each side of the handbag body exactly the same way as the foregoing embodiment. A laminated decorative cover 11 is held between the frame member 10 and the handbag body. Further, a strap band 12 is attached to the frame member 10 at its lower portion and adapted to be fastened to the frame member 10 at its upper portion by a snap fastener as depicted to hold the laminated decorative cover 11 thereunder.

As described in the foregoing, a handbag according to the present invention comprises a laminated decorative cover having a multi layer structure held under a frame member at its perpheral portion. Since the laminated decorative cover is thin in its marginal portion and thick in its central portion, said cover member will not raise the inside margin of the frame member when inserted thereinto with the result that a gap will not be produced between the laminated cover member and the inside margin of the frame. Also, as already described, material can be selected freely to obtain a laminated decorative cover which has a good appearance and is soft to the touch.

Furthermore, since the cover member with the above mentioned structure is not required to be strictly uniform in its configuration while the attachment is easy, the handbag of the invention has such an advantage as that anybody can easily and freely enjoy a variety of purse designs. In addition, materials for the face sheet can be freely selected.

What is claimed is:

1. A handbag, comprising:

a body section having a front side and a back side;

a frame member attached to at least one of said front and back sides at an outside margin thereof, said frame member having a lower portion and an upper portion;

a laminated decorative cover inserted between at least one of said front and back sides at an outside margin thereof and said frame member, said laminated decorative cover being composed of a face sheet, a central core sheet and a back sheet with said central core sheet being disposed between said face sheet and said back sheet, said face and back sheets being bonded directly to each other at a peripheral margin thereof, said central core sheet being bonded to said face and back sheets at selected points;

a strap band attached to said frame member at said lower portion; and means for releasably securing said strap band to said upper portion of said frame member to support said laminated decorative cover.

2. A handbag according to claim 1, wherein said laminated decorative cover is thin at its peripheral margin, and thick at its central portion.

* * * * *